US005418206A

United States Patent [19]

Smith

[11] Patent Number: 5,418,206

[45] Date of Patent: * May 23, 1995

[54] HIGH GLOSS, ABRASION RESISTANT, THERMOSENSITIVE RECORDING ELEMENT

[75] Inventor: Albert H. Smith, Carrollton, Tex.

[73] Assignee: International Paper Company, Purchase, N.Y.

[ * ] Notice: The portion of the term of this patent subsequent to Oct. 22, 2009 has been disclaimed.

[21] Appl. No.: 781,561

[22] Filed: Oct. 22, 1991

[51] Int. Cl.[6] ..... B41M 5/40

[52] U.S. Cl. ..... 503/209; 427/152; 503/214; 503/216; 503/220; 503/221; 503/226

[58] Field of Search ..... 503/200, 226, 209, 214, 503/216, 221; 427/152

[56] References Cited

U.S. PATENT DOCUMENTS

| | | | |
|---|---|---|---|
| 3,936,309 | 2/1976 | Kohmura et al. | 106/21 |
| 4,061,831 | 12/1977 | Quast | 428/480 |
| 4,255,491 | 3/1981 | Igarashi | 428/537 |
| 4,286,017 | 8/1981 | Nakamura et al. | 428/328 |
| 4,415,633 | 11/1983 | Nakamura et al. | 428/411 |
| 4,444,819 | 4/1984 | Maruta et al. | 346/209 |
| 4,460,626 | 7/1984 | Nakamura et al. | 427/150 |
| 4,467,336 | 8/1984 | Koike | 346/200 |
| 4,551,738 | 11/1985 | Maruta | 346/200 |
| 4,682,191 | 7/1987 | Tamagawa et al. | 503/200 |
| 4,717,593 | 1/1988 | Igarashi et al. | 427/150 |
| 4,772,581 | 9/1988 | Miyauchi et al. | 503/200 |
| 4,885,271 | 12/1989 | Kawakami et al. | 503/214 |
| 4,889,841 | 12/1989 | Kosaka et al. | 503/209 |

FOREIGN PATENT DOCUMENTS

| | | | |
|---|---|---|---|
| 037090 | 9/1982 | Japan | 503/226 |

*Primary Examiner*—B. Hamilton Hess

*Attorney, Agent, or Firm*—Ostrager, Chong & Flaherty

[57] ABSTRACT

An abrasion resistant thermosensitive recording element having high gloss, and improved abrasion resistance and process of preparing said element are described. The element comprises (a) a support, (b) a first layer comprising an organic polymeric binder and a substantially colorless electron donating dye precursor, and (c) a second layer comprising an organic polymeric binder compatible with the binder in (b); an electron accepting compound capable of forming color by reaction with said dye precursor, and a crosslinking agent, wherein the first layer is interposed between the support and the second layer. These elements have wide application in the printing industry.

25 Claims, No Drawings

HIGH GLOSS, ABRASION RESISTANT, THERMOSENSITIVE RECORDING ELEMENT

FIELD OF THE INVENTION

This invention relates to thermosensitive recording elements and, in particular, to a thermosensitive recording element having high gloss and improved abrasion resistance. This invention also concerns a process for preparing thermosensitive recording elements having high gloss and improved abrasion resistance.

BACKGROUND OF THE INVENTION

Thermosensitive recording elements have wide application in the printing industry. For example, thermosensitive recording elements have been used in recording instruments for measurements such as facsimiles, printers, thermal devices for computers, devices for preparing architectural and engineering drawings, automatic vending machines for dispensing railroad tickets and luggage tags, and thermal label printing devices. Conventional thermosensitive recording elements generally comprise a support and a thermosensitive recording layer provided thereon. The thermosensitive recording layer primarily contains a binder, a substantially colorless electron donating dye precursor and an electron accepting compound also known as a developer. Upon heating, by means of a thermal head, a thermal pen or laser beam, the dye precursor instantaneously reacts with the electron accepting compound to form a recorded image.

It has been found that defects in the imaging surface of thermosensitive recording elements can be easily obtained. For example, rubbing the element gently with hard objects such as paper clips, fingernails and dirt particles or even folding the element can result in undesirable imprints in the imaging surface. This presents a barrier to their use as facsimile papers, architectural and engineering drawings, luggage tags, thermal printed labels, and the like.

Abrasion resistance can be greatly improved by separating the imaging components, i.e., the colorless dye precursor and the developer. This is achieved by applying, for example, the developer containing coating composition to a support that is first coated with the dye precursor containing composition. Although abrasion resistance is improved, the resulting heat sensitive product has been found to have a relatively low gloss as indicated by a total reflection of 30 to 50 percent of incident light and has a flat or low gloss appearance. Furthermore, due to the hydrophilic nature of the polymeric binders in the two component compositions, these coatings are subject to image development when stained with water.

Another way of improving abrasion resistance in thermosensitive recording elements is the use of high gloss coatings. The use of high gloss coatings is advantageous in thermal painted labels, tags, or material for advertising. Such coatings can be produced by adding a top coating containing film forming polymers such as polyvinylalcohol or acrylic-methacrylic copolymers over the outermost layer, for example, the developer containing layer produced by the two coating process. However, polymer containing top coats such as these reduce much of the abrasion resistance afforded by the two coating techniques, and they are subject to image development when stained with water. In addition, the low softening point of such polymers, causes the polymer to adhere to the print head of thermal printers, thereby forming images of poor quality. The additional layer also adds to the cost of the thermosensitive element.

High gloss coatings having good abrasion resistance may be produced by applying glyoxal/p-toluenesulfonic acid/polyvinylalcohol containing coatings to a support that is coated with a composition containing both dye precursor and developer in the same layer. However, such top coats tend to promote the reaction of dye precursor and developer resulting in development, and therefore, a gray color to the background areas of the coated element is produced.

Accordingly, a need exists for thermosensitive recording elements that have improved abrasion resistance without producing the shortcomings discussed above. It has been found that these conditions are met using the thermosensitive recording element of the invention.

SUMMARY OF THE INVENTION

The present invention provides a thermosensitive recording element having high gloss, and improved abrasion resistance said element comprising:

(a) a support;

(b) a first layer comprising an organic polymeric binder and a substantially colorless electron donating dye precursor; and (c) a second layer comprising (i) an organic polymeric binder compatible with the binder in (b), (ii) an electron accepting compound capable of forming color by reaction with said dye precursor, and (iii) a crosslinking agent, wherein the first layer is interposed between the support and the second layer.

In another embodiment, there is provided a process for preparing a thermosensitive recording element having high gloss and improved abrasion resistance comprising the steps of:

(a) providing a support;

(b) preparing a first dispersion of an aqueous solution comprising an organic polymeric binder and a substantially colorless, electron donating dye precursor;

(c) preparing a second dispersion of an aqueous solution comprising an organic polymeric binder compatible with the binder in (b), an electron accepting compound capable of forming color by reaction with said dye precursor, and a crosslinking agent;

(d) applying the first dispersion onto the support;

(e) drying the first applied dispersion to form a first layer on the support;

(f) applying the second dispersion on the first layer formed in step (e); and (g) drying the second applied dispersion to form a second layer.

DETAILED DESCRIPTION OF THE INVENTION

The thermosensitive recording element of the invention comprises (a) a support, (b) a first layer comprising a substantially colorless electron donating dye precursor and an organic polymeric binder; and (c) a second layer comprising an electron accepting compound, an organic polymeric binder, and a crosslinking agent. The first layer is interposed between the support and second layer.

Surprisingly and unexpectedly, it was found that the addition of a crosslinking agent to the second or uppermost layer, which is free of dye precursor, produces an element that is remarkably resistant to abrasion and water staining. Furthermore, the element does not adhere to thermal print heads.

Electron Donating Dye Precursor

The first layer of the thermosensitive recording element of the invention contains a substantially colorless electron donating dye precursor. By the term "substantially colorless" it is meant background optical density less than or equal to 0.10.

Electron donating dye precursors used in ordinary pressure-sensitive recording papers, thermosensitive recording papers, etc. are useful in practicing the present invention. Suitable electron donating dye precursors are disclosed in U.S. Pat. No. 4,889,841 issued to Kosaka et al., U.S. Pat. No. 4,885,271 issued to Kawakami et al., and U.S. Pat. No. 4,467,336 issued to Koike and include the following compounds:

(1) triarylmethane compounds such as 3,3-bis (p-dimethylaminophenyl) -6-dimethylaminophthalide (Crystal Violet lactone), 3, 3-bis(p-dimethylaminophenyl) phthalide, 3-(p-dimethylaminophenyl) -3-(1,2-dimethylindol-3-yl) phthalide, 3-(p-dimethylaminophenyl)-3-(2-methylindol-3-yl) phthalide, 3-(p-dimethylaminophenyl) -3-(2-phenylindol-3-yl) phthalide, 3-3-bis (1,2-dimethyl-indol-3-yl) -5-dimethylaminophthalide, 3,3-bis (1, 2-dimethylindol-3-yl) -6-dimethylaminophthalide, 3,3-bis (9-ethylcarbazol-3-yl) -5-dimethylaminophthalide, 3,3-bis ( 2-phenylindol-3-yl) -5-dimethylaminophthalide, 3-p-dimethylaminophenyl-3-(1-methylpyrrol-2-yl)-6-dimethylaminophthalide, etc.;

(2) diphenylmethane compounds such as 4,4'-bis-dimethylaminobenzhydryl benzyl ether, N-halophenyl leuco Auramine, N-2,4,5-trichlorophenyl leuco Auramine, etc.;

(3) xanthene compounds such as Rhodamine B anilinolactam, Rhodamine B p-chloroanilinolactam, 3-diethylamino-7-dibenzylaminofluoran, 3-diethylamino-7-octylaminofluoran, 3-diethylamino-7-(3,4-dichloroanilino) fluoran, 3-diethylamino-7-(2-chloroanilino) fluoran, 3-diethylamino-6-methyl-7-anilinofluoran, 3-piperidino-6-methyl-7-anilinofluoran, 3-ethyl-tolylamino-6-methyl-7-anilinofluoran, 3-ethyltolylamino-6-methyl-7-phenylfluoran, 3-diethylamino-7(4-nitroanilino) fluoran, 3-dibutylamino-6-methyl-7-anilinofluoran, 3-(N-methyl-N-propyl) amino-6-methyl-7-anilinofluoran, 3-(N-ethyl-N-isopropyl) amino-6-methyl-7-anilinofluoran, 3-(N-ethyl-N-tetrahydrofurfuryl) amino-6-methyl-7-anilinofluoran, 3-(N-ethyl-N-isopentyl) amino-6-methyl-7-anilinofluoran; 3-(N-cyclohexyl-N-methyl)-amino-6-methyl-7-anilinofluoran; 3-diethylamino-6-methyl-7-anilinofluoran; 3-dibutylamino-6-methyl-7aninofluoran; 3-(N-ethyl-N-(3-ethoxy)propyl)-amino-6-methyl-7-anilinofluoran; 3-dipentyl-amino- 6-methyl-7-aninofluoran, etc.;

(4) thiazine compounds such as benzoyl leuco methylene blue, p-nitrobenzoyl leuco methylene blue, etc.; and (5) spiro compounds such as 3-methyl-spirodinaphthopyran, 3-ethyl-spirodinaphthopyran, 3,3'-dichloro-spirodinaphthopyran, 3-benzyl-spirodinaphthopyran, 3-methylnaphtho-(3-methoxybenzo) spiropyran, 3-propyl-spirodibenzopyran, etc. Also useful are mixtures of these dye precursors.

In practicing the invention, preferred electron donating dye precursors are (i) 3,3-bis (p-dimethylaminophenyl)-6-dimethylaminophthalide, (ii) 3-(N-ethyl-N-isopentyl)-amino-6-methyl-7-anilinofluoroan, and (iii) 3-dipentyl-amino-6-methyl-7-aninofluoran. The electron donating dye precursor may be present in the amount of about 1 to 15 percent, preferably about 3 to 8 percent, by weight based on the weight of the coating composition.

Electron Accepting Compound

The second layer of the thermosensitive recording element of the invention comprises an electron accepting compound. The electron accepting compound used in practicing the invention is also known as an acidic developer. Suitable electron accepting compounds are capable of forming color by reacting with an electron donating dye precursor. Such compounds are disclosed in U.S. Pat. No. 4,889,841 issued to Kosaka et al., U.S. Pat. No. 4,885,271 issued to Kawakami et al., and U.S. Pat. No. 4,467,336 issued to Koike. Specific electron accepting compounds suitable for practicing the invention include phenol derivatives, aromatic carboxylic acid derivatives, N,N'-diarylthiourea derivatives, and polyvalent metal salts such as zinc salts of organic compounds.

Particularly preferred electron accepting compounds are phenol derivatives. Specific examples include p-octylphenol, p-tert-butylphenol, p-phenylphenol, 1,1-bis (p-hydroxyphenyl-propane, 1,1-bis(p-hydroxyphenyl) pentane, 1,1-bis(p-hydroxyphenyl) hexane, 2,2-bis(p-hydroxyphenyl) hexane, 1,1-bis(p-hydroxyphenyl) -2-ethylhexane, 2,2-bis(4'-hydroxyphenyl propane, 2,2-bis (4-hydroxy-3-dichlorophenyl) propane, benzyl p-hydroxybenzoate, ethyl p-hydroxybenzoate, butyl p-hydroxybenzoate, p-p'-dihydroxydiphenylsulfone, 2,2'-diallyl-4,4'-dihydroxydiphenylsulfone, and 2,2'-dimethyl-4,4'-dihydroxydiphenylsulfide. Mixtures of these compounds may also be used.

In practicing the invention preferred electron accepting compounds are (i) 2,2-bis (4'-hydroxyphenyl), (ii) benzyl-p-hydroxybenzoate, and (iii) 2,2'-diallyl-4,4'-dihydroxydiphenylsulfone.

The electron accepting compounds may be present in the amount of about 50 to 500 percent, preferably about 100 to 200 percent, by weight based on the weight of the dye precursor.

Binders

Organic polymeric binders are present in both layers of the thermosensitive recording element. Suitable organic polymeric binders include water soluble binders having a molecular weight of 20,000 to 200,000 such as starches, hydroxyethyl cellulose, methyl cellulose, carboxymethyl cellulose, soluble collagen, gelatin, casein, polyacrylamide, polyvinyl pyrrolidone, polyvinyl alcohol, polyvinyl alcohol copolymers such as poly(vinyl alcohol-co-vinyl acetate) also known as partially hydrolyzed polyvinyl alcohol, sodium alginate, water soluble phenol formaldehyde resins, styrene-maleic anhydride copolymer, ethylene-maleic anhydride copolymer, ethylene vinyl acetate polymers, etc.; latex type water soluble binders such as styrene-butadiene copolymer, acrylonitrile-butadiene copolymer, methyl acrylatebutadiene copolymer, etc., acrylic resins such as poly(-methyl methacrylate/ethyl acrylate/acrylic acid), etc.

The organic polymeric binder is present as an aqueous solution having a concentration of about 1 to 20 percent by weight, preferably about 3 to 10 percent by weight. If the concentration is less than 1 percent, stability of the dispersed particles will be inferior and cohesion may occur during the heating step. If the concentration is greater than 20 percent, the viscosity of the dispersion increases remarkably thus requiring a large amount of energy to perform the dispersion.

Crosslinking Agents

The second layer of the thermosensitive recording element contains a crosslinking agent. It is believed that the crosslinking agent forms crosslinked acetal linkages with the pendant hydroxyl groups in the polymeric binder. Crosslinking agents useful in practicing the invention include those which are known to crosslink organic polymeric binders, such as mono and polyfunctional aldehydes, e.g., formaldehyde and free dialdehydes, such a glyoxal, succinaldehyde and glutaraldehyde, as described by Allen et al., U.S. Pat. No. 3,232,764; blocked dialdehydes, as described by Kaszuba, U.S. Pat. No. 2,586,168; Jeffreys, U.S. Pat. No. 2,870,013; and Yamamoto et al., U.S. Pat. No. 3,819,608.

Other useful crosslinking agents include (a) $\alpha$-diketones, as described by Allen et al., U.S. Pat. No. 2,725,305; (b) active esters of the type described by Burness et al., U.S. Pat. No. 3,542,558; (c) active halogen compounds as described by Burness, U.S. Pat. No. 3,106,468; Silverman et al., U.S. Pat. No. 3,839,042; Ballantine et al., U.S. Pat. No. 3,951,940 and Himmelmann et al., U.S. Pat. No. 3,174,861; (d) s-triazines and diazines, as described by Yamamoto et al., U,S. Pat. No. 3,325,287, Anderau et al., U.S. Pat. No. 3,288,775 and Stauner et al., U.S. Pat. No. 3,992,366; (e) epoxides, as described by Allen et al., U.S. Pat. No. 3,047,394, Burness, U.S. Pat. No. 3,189,459 and Birr et al., German Patent No. 1,085,663; and (f) aziridines, as described by Allen et al., U.S. Pat. No. 2,950,197, Burness et al., U.S. Pat. No. 3,271,175 and Sato et al., U.S. Pat. No. 3,575,705.

Crosslinking agents of mixed function, such as halogen-substituted aldehyde acids, e.g., mucochloric and mucobromic acids, as described by White, U.S. Pat. No. 2,080,019 may also be used in practicing the invention. In addition, vinyl sulfones containing other hardening functional groups, as described by Sera et al., U.S. Pat. No. 4,028,320; and polymeric crosslinking agents, such as dialdehyde starches, as described by Jeffreys et al., U.S. Pat. No. 3,057,723, and copoly(acrolein-methacrylic acid), as described by Himmelmann et al., U.S. Pat. No. 3,396,029 may be used as crosslinking agents. Some useful polyfunctional aziridines: Pentaerythritol-tri [$\beta$-(N-aziridinyl) propionate]:

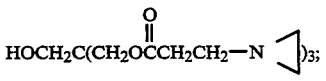

Trimethylolpropane-tri $\beta$-(N-aziridinyl) propionate ]:

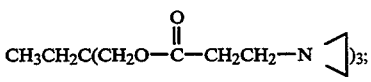

and trimethylolpropane-tri $\beta$-(N- (methylazridinyl)) propionate]

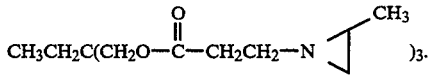

Other polyfunctional aziridines can be employed, e.g., pentaerythritol-tri[$\beta$-(N-(alkyl or dialkyl-substituted aziridinyl))propionate] wherein alkyl is of 1 to 6, preferably 1 to 4, carbon atoms.

Preferred crosslinking agents used in practicing the invention are glyoxal, glutaric dialdehyde and propionaldehyde. The crosslinking agent is present in the amount of about 2 to 6 percent, preferably about 3 to 5 percent based on the total layer composition.

Catalyst

Catalysts may be used in combination with the crosslinking agent. Suitable catalysts are selected from the group consisting of mineral acids, e.g., hydrochloric, hydrobromic, sulfuric, nitric, phosphoric and boric acids; organic acids, e.g., p-toluenesulfonic, p-dodecylbenzene sulfonic, trichloroacetic, trifluoroacetic, perfluoroheptanoic, acetic, etc.; and an acid from a compound supplying acid, e.g., Lewis acid selected from the group consisting of zinc chloride, zinc bromide, ferric chloride, etc. In practicing the invention, a preferred catalyst is p-toluenesulfonic acid.

The catalyst is present in the amount of about 0.3 to 2 percent and preferably 0.4 to 1 percent based on the total layer composition.

Additives

Additives may be present in the dye precursor-containing layer and the developer-containing layer. Acceptable additives include pigments, waxes, lubricants, activation cosolvents, higher fatty acid metal salts, surface active agents, mold inhibitors, dispersing agents, UV absorbing agents, fluorescent dyes, optical brighteners, defoaming agents, and the like. Also useful are heat fusible materials which may lower the melting point of the dye precursor or developer to improve color sensitivity at low temperatures. Preferably, the waxes and higher fatty acid metal salts are in the uppermost layer where they assist in preventing the thermosensitive element from adhering to or scratching the thermal head of the recording device.

Useful pigments include diatomaceous earth, talc, kaolin, sintered kaolin, calcium carbonate, magnesium carbonate, titanium oxide, zinc oxide, silicon oxide, aluminum hydroxide, urea-formalin resin, etc.

Useful heat fusible materials include B-naphthol benzylether, p-benzylbiphenyl, ethylene glycol m-tolyl ether, m-terphenyl, bis(2-(4-methoxy)phenoxyethyl)ether, dibenzyloxalate, di(p-chlorobenzyl) oxalate, di(p-methylbenzyl)oxalate and dibenzyl terephthalate. Heat fusible materials may be present in the amount of about 25 to 500 percent, preferably about 50 to 200 percent, by weight based on the weight of dye precursor.

Examples of higher fatty acid metal salts are zinc stearate, calcium stearate. Useful waxes include paraffin, oxidized paraffin, polyethylene, oxidized polyethylene, stearic amide and castor wax. Dispersing agents such as sodium dioctylsulfosuccinate, etc.; UV absorbing agents of the benzophenone type, benzotriazole type etc.; and mold inhibitors such as sodium-ophenylphenate tetrahydrate, etc., are also useful additives.

Supports

The thermosensitive recording layers of the invention rest on a support. Acceptable supports include sheet-formed materials such as paper, e.g., 100 percent bleached hardwood Kraft and bleached softwood Kraft, wood free cotton vellum, and wood-containing paper made translucent either by pulp beating or with additives; transparent films such as polyethylene terephthalate; non-woven cloth; metal foil; and mixtures thereof. Paper is the preferred support in practicing the invention.

Dispersion Preparation and Coating

The process of the invention describes preparing a thermosensitive recording element having high gloss and improved abrasion resistance said element comprising (a) a support; (b) a first layer comprising an organic polymeric binder and a substantially colorless electron donating dye precursor; and (c) a second layer comprising an organic polymeric binder compatible with the binder in (b) , an electron accepting compound and a crosslinking agent. The process for making such an element comprises the steps of:

(a) providing a support;
(b) preparing a first dispersion of an aqueous solution comprising an organic polymeric binder and a substantially colorless, electron donating dye precursor;
(c) preparing a second dispersion of an aqueous solution comprising an organic polymeric binder compatible with the binder in (b), an electron accepting compound capable of forming color by reaction with said dye precursor, and a crosslinking agent;
(d) applying the first dispersion onto the support;
(e) drying the first applied dispersion to form a first layer on the support;
(f) applying the second dispersion on the first layer formed in step (e); and
(g) drying the second applied dispersion to form a second layer.

A first dispersion of an aqueous solution comprising an organic polymeric binder and a substantially colorless, electron donating dye precursor is first prepared. A second dispersion of an aqueous solution comprising an organic polymeric binder, an electron accepting compound and a crosslinking agent is then prepared. The electron accepting compound must be capable of forming color by reaction with said dye precursor, and the binder in the second dispersion must be compatible with the binder in the first dispersion. By the term "compatible with the binder" it is meant that the binder in the second layer be either identical to or have similar properties to the binder in the first layer. For example, it is important that the two binders are miscible with one another and that they do not chemically react with one another.

The first dispersion is then applied onto the support and dried to form a first layer on the support. The second dispersion is subsequently applied onto the dried first layer on the support and dried to form a second layer.

The first and second dispersions are generally prepared with an aqueous solution of the organic polymeric binder as the dispersion medium. In addition to the binder, the first dispersion contains a substantially colorless electron donating dye precursor. Similarly, in addition to the binder, the second dispersion contains an electron accepting compound. The crosslinking agent is added to the second dispersion once the particle size has been reduced. The dye precursor and the electron accepting compound in their respective dispersions preferably have a particle size of about 0.5 to 3 $\mu$. Thermal response in the thermosensitive element is generally insufficient if the particle size is greater than 3 $\mu$. A significant amount of energy is required to carry out the dispersion if the particle size is less than 0.5 $\mu$. In addition, fogging is observed with particle sizes less than 0.5 $\mu$.

The dye precursor-containing dispersion is adjacent to the support and may also contain some electron accepting compound. The ratio of the dye precursor to the electron accepting compound in this layer is in the range of about 1:1 to 10:1, preferably about 2:1 to 4:1.

The dispersion containing the dye precursor is prepared by grinding the dye precursor and optionally other suitable additives along with an aqueous solution of the organic polymeric binder in a grinding device such as a ball mill; a sand mill, such as a horizontal sand mill; an attritor, etc. Preferably a horizontal sand mill containing zirconium silicate media is used. The dispersion is subjected to continuous grinding until an average particle size of about 0.5–3 $\mu$, preferably about 0.8–1$\mu$ is obtained.

The electron accepting compound containing dispersion is prepared by grinding the electron accepting compound, aqueous solution of the organic polymeric binder and suitable additives in one of the above described grinding devices until the average particle size of about 0.5–3 $\mu$, preferably about 0.8–1 $\mu$, is obtained. The crosslinking agent and optionally the catalyst is then added to the above dispersion.

Alternatively, separate dispersions containing either the dye precursor, or the electron accepting compound, crosslinking agent, catalyst or any of the other additives may be prepared by grinding the individual ingredients along with an aqueous solution of the organic polymeric binder in a grinding device until the desired average particle size is obtained. Coating dispersions or compositions may then be prepared by blending the individual dispersions in ratios that produce the desired weight percentage of the individual ingredients as a percentage of total weight of the coating dispersion.

The dye precursor-containing dispersion is applied, preferably coated, using any conventional coating apparatus, onto a support which is preferably paper. The dispersion is dried at about 25° to 50° C., preferably 45° to 50° C. for 2 to 30 minutes, preferably 2 to 5 minutes. The dye precursor in the coated layer is present in the amount of about 0.3 g/m$^2$ to 1.6 g/m$^2$, preferably 0.4 g/m$^2$ to 0.8 g/m$^2$. After drying, the electron accepting compound-containing dispersion is applied, preferably coated onto the dried dye precursor-containing layer followed by drying under the same conditions. The electron accepting compound in the coated layer is present in the amount of 0.2 g/m$^2$ to 2.7 g/m$^2$, preferably 0.7 g/m$^2$ to 1.3 g/m$^2$. Alternatively, the electron accepting compound is present in an amount of about 50–500 percent, preferably about 100–200 percent by weight based on the weight of dye precursor present in the first applied layer. It is preferred that drying be conducted in such a manner that the moisture content of the thermosensitive recording element is within the range of from about 5 percent by weight to about 9 percent by weight based on the total weight of the recording element.

Additional layers may be applied to the dried recording element thus described to impart different surface characteristics such as gloss, smoothness, color, resistance to inorganic or organic solvents, or additional abrasion resistance. However, in an element having more than two layers, it is preferred that the outermost layer of the recording element be free of dye precursor. For elements having more than two layers, it has been found that the presence of dye precursor in the outermost layer causes the element to become too heat sensitive which can lead to "image bleeding" or "smearing" from the trailing edge of images. The additional layer or layers may comprise an organic polymeric binder compatible with the binder in the adjacent layer and an electron accepting compound. If the additional layer is the outermost layer, that layer should comprise an organic polymeric binder, a crosslinking agent, and preferably a catalyst to obtain the benefits identified with this invention. The outermost layer may also contain compounds selected from the group consisting of pigments, waxes, higher fatty acid metal salts, optical brighteners, and mixtures thereof.

The cumulative amount of electron accepting compound in all layers of the composition should fall in the range of about 50–500 percent, preferably about 100–200 percent by weight based on the total amount of dye precursor used in the coated material.

The thermosensitive element of the invention and the process of preparing said element produces a surface that (1) is hard, (2) has a low coefficient of friction, (3) has high gloss as indicated by a 50–75 percent total reflection, (4) is remarkably resistant to abrasion and water staining, and (5) does not adhere to thermal print heads. Furthermore, the presence of a crosslinking agent and small quantities of an acid catalyst in the layer that does not contain both the dye and the developer significantly reduces background development. Thus, background areas having grayness is avoided.

EXAMPLES

The following examples further illustrate, but do not limit, the invention. The parts and percentages are by weight unless otherwise noted. Average particle size was measured using a Microtrac Model 7998 SPA Particle Size Analyzer, Leeds & Northrup Co., St. Petersburg, Fla.

EXAMPLE 1

The following dispersions were prepared by first preparing a preliminary slurry of the individual ingredients described below in the proportions shown using a Cowles mixer (Model-24, Moorehouse Industries, Los Angeles, Calif.). These slurries were then ground in a 20 liter horizontal grinding mill (Model EHA-20 Supermill, Premier Mill Corp., Reading, Pa.) using zirconium silicate grinding media of 0.6–0.8 mm particle size. The ingredients were subjected to continuous grinding in this mill at residence times of 10 minutes/liter until analysis showed each dispersion contained particles of 1–2 microns in diameter.

DISPERSION A (Dye Precursor Dispersion)

3-(N-diethyl)-amino-6-methyl-7-anilinofluoran (29 Kg) and 116 Kg or 7 percent (by weight) solution of polyvinylalcohol in water were ground in a Premier Mill at a flow rate of 1.26 liter/minute until analysis showed the dispersion contained particles of 1.38 $\mu$ average size.

DISPERSION B (Electron Accepting Compound or Developer Dispersion)

A dispersion similar to Dispersion A was prepared except that 29 Kg of p-hydroxybenzylbenzoate was used in place of the fluoran dye in Dispersion A. After grinding in the Premier Mill, Dispersion B was shown to contain particles with 1.31$\mu$ average diameter.

Dispersions A and B were blended with other ingredients to prepare the following coating compositions:

| INGREDIENT | WEIGHT % |
|---|---|
| COMPOSITION 1 | |
| 3-(N-diethyl)-amino-6-methyl-7-aminofluoran | 6.0 |
| Polyvinylalcohol (7% in water) | 94.0 |
| COMPOSITION 2 | |
| p-Hydroxybenzylbenzoate | 6.0 |
| Polyvinylalcohol (7% in water) | 94.0 |
| COMPOSITION 3 (Developer/Glyoxal/PTSA) | |
| p-Hydroxybenzylbenzoate | 5.7 |
| Glyoxal (40% in water) | 10.6 |
| p-Toluenesulfonic acid, PTSA (20% in water) | 2.7 |
| Polyvinylalcohol (7% in water) | 47.3 |
| Water | 28.7 |
| Surfynol ® 104, Air Products and Chemicals, Inc., Allentown, PA | 0.5 |

| COMPONENT | WEIGHT % |
|---|---|
| COMPOSITION 4 (Dye Precursor and Developer) | |
| 3-(N-diethyl)-amino-6-methyl-7-aninofluoran | 3.0 |
| p-Hydroxybenzylbenzoate | 3.0 |
| Polyvinylalcohol (7% in water) | 54.0 |
| COMPOSITION 5 (Glyoxal/PTSA/Polyvinylalcohol) | |
| Glyoxal (40% in water) | 10.3 |
| p-Toluenesulfonic acid, PTSA (20% in water) | 2.6 |
| Polyvinylalcohol (7% in water) | 51.5 |
| Water | 32.2 |
| Surfynol ® 104 Air Products and Chemicals, Inc., Allentown, PA | 0.5 |
| COMPOSITION 6 (Glutaric Dialdehyde/PTSA/Polyvinylalcohol) | |
| Glutaric dialdehyde (25% in water) | 4.1 grams |
| p-Toluenesulfonic acid, PTSA (20% in water) | 1.0 grams |
| Polyvinylalcohol (Elvanol 51-05 ®) (14% in water) | 63.9 grams |
| Water | 31.0 grams |

EXAMPLE 2

A thermosensitive recording element was prepared according to the following procedure. Base paper having a basis weight of 81.6 g/m$^2$ was coated with Composition 1 from Example 1, using a Meyer Rod. After drying at room temperature under forced air, the paper with Composition 1 applied thereon, had a coating weight of 1.95 g/m$^2$.

The dried coated paper was further coated with Composition 3 and likewise air dried for 30 minutes at room temperature under forced air. Analysis showed this coating had a coating weight of 2.28 g/m$^2$.

The resulting coated paper was white in color, had high gloss as indicated by 60 percent reflectance and was resistant to scratching with a fingernail. One drop of water applied to the surface of the coated surface left no mark after 12 hours at room temperature. When printed in a thermal printer (Gulton Model SP 80 ATSBI, Thermal Printer, Gulton Co., East Greenwich, R.I.) the paper had a background absorbance of 0.08 O.D. as measured by reflectance densitometry. The printed images were highly glossy and had a density of 1.60 O.D.

Comparative Example 2

A thermosensitive recording element was prepared according to the following procedure. Base paper having a basis weight of 81.6 g/m$^2$ was coated as described in Example 2 except that after the dye precursor containing coating from Composition 1 was applied and dried to achieve a coating weight of 2 28 g/m$^2$ the coated paper was further coated with Composition 2 from Example 1, to achieve a coating weight of 2.12 g/m$^2$ and dried as with Example 2. The resulting coated element was white in color, had good abrasion resistance but had low gloss as indicated by a 30 percent reflectance. When printed in a Gulton Printer, the paper had a background absorbance of 0.06 O.D. and an image density of 1.31 O.D. One drop of water placed on the coated surface produced a black mark within 1 hour at room temperature.

Comparative Example 3

A thermosensitive recording element was prepared according to the procedure described in Comparative Example 2. The coating weights of the first and second applied coatings were 2.28 and 2.12 g/m$^2$ respectively. After the second application with Composition 2, the element was further coated with a solution of 7 percent polyvinylalcohol in water. The resulting coated paper was shown to have a coating weight of 0.98 g/m$^2$. The coated paper had high gloss as indicated by a reflectance of 65 percent but was much more easily marked by rubbing with a fingernail than Example 2 or Comparative Example 2. When printed in a Gulton Printer, the coated paper adhered to the printing head and produced images showing melt lines in the image. Background absorbance was 0.06 and image absorbance was 1.42 O.D.

Comparative Example 4

A thermosensitive recording element was prepared according to the procedure described for Example 2 except that the combined dye precursor/developer Composition 4 was used for the first coating application. The resulting coated paper was air dried at room temperature for 30 minutes and had a coating weight of 3.26 g/m$^2$. The coated paper was easily marked by even gentle rubbing with a fingernail.

The coated paper was further coated with Composition 5 (glyoxal/PTSA/polyvinylalcohol) and air dried as in Example 2. The second coating had a coating weight of 1.30 g/m$^2$.

The resulting coated paper was slightly gray in color and background absorbance was 0.14 O.D. The coated paper exhibited high gloss as indicated by a 65 percent reflectance and was remarkably resistant to fingernail abrasion. When printed in a Gulton Thermal Printer, the coated paper gave shiny images with absorbance of 1.70 O.D.

Compared to Example 2, the background color of the coated paper increased with time when stored at room temperature. After 24 hours, the coated paper was noticeably darker in color and had a background absorbance of 0.22 O.D.

Comparative Example 5

A thermosensitive recording element was prepared according to the procedure described for Example 2 except that the combined dye precursor/developer Composition 4 was used for the first coating application. The resulting coated paper was air dried at room temperature for 30 minutes and had a coating weight of 5.22 g/m$^2$. The coated paper was easily marked by even gentle rubbing with a fingernail.

The coated paper was further coated with Composition 6 (glutaric dialdehyde/PTSA/polyvinyl-alcohol) and air dried as in Example 2. The second coating had a coating weight of 1.47 g/m$^2$.

The resulting coated paper was off-white in color and had a background absorbance of 0.07 O.D. The coated paper exhibited high gloss as indicated by 65% reflectance and was remarkably resistant to fingernail abrasion. When printed in a Gulton Thermal Printer, the coated paper gave images with absorbance of 1.45 O.D.

After 24 hours, the coated paper had a background absorbance of 0.07 and no change in background color.

What is claimed is:

1. A thermosensitive recording element having high gloss and improved abrasion resistance, said element comprising:

(a) a support;

(b) a first layer comprising an organic polymeric binder and a substantially colorless electron donating dye precursor, said dye precursor present in the amount of about 1 to 15 percent based on the weight of the coating composition; and (c) a second layer comprising (i) an organic polymeric binder compatible with the binder in (b), (ii) an electron accepting compound capable of forming color by reaction with said dye precursor, said electron accepting compound present in the amount of about 50 to 500 percent by weight based on the weight of said dye precursor and (iii) a crosslinking agent, wherein the first layer is interposed between the support and the second layer and together form a coating on said support;

said dye precursor is selected from the group consisting of triarylmethane compounds, diphenylmethane compounds, xanthene compounds, thiazine compounds and spiro compounds;

said electron accepting. compound is selected from the group consisting of phenol derivatives, aromatic carboxylic acid derivatives, and polyvalent metal salts;

said crosslinking agent is selected from the group consisting of mono- and polyfunctional aldehydes, blocked dialdehydes, α-diketones, active esters, active halogen compounds, s-triazines, diazines, epoxides, aziridines, halogen-substituted aldehyde acids, vinyl sulfones containing hardening functional groups, and polymeric crosslinking agents;. and said organic polymeric binder in said first and second layers are water soluble binders having a molecular weight of 20,000 to 200,000 and are each applied from aqueous solutions having a concentration of 1 to 20 percent by weight.

2. The thermosensitive recording element of claim 1 wherein said dye precursor is 3,3-bis (p-dimethylaminophenyl) -6-dimethylaminophthalide.

3. The thermosensitive recording element of claim 1 wherein said dye precursor is 3-(N-ethyl-N-isopentyl)-amino-6-methyl-7-anilinofluoran.

4. The thermosensitive recording element of claim 1 wherein said dye precursor is 3-dipentyl-amino-6-methyl-7-anilinofluoran.

5. The thermosensitive recording element of claim 1 wherein said dye precursor is present in the amount of 3 to 8 percent by weight based on the weight of the coating composition.

6. The thermosensitive recording element of claim 1 wherein said electron accepting compound is 2,2-bis(4'-hydroxyphenyl)propane.

7. The thermosensitive recording element of claim 1 wherein said electron accepting compound is benzyl p-hydroxybenzoate.

8. The thermosensitive recording element of claim 1 wherein said electron accepting compound is 2,2'-diallyl-4,4'-dihydroxydiphenylsulfone.

9. The thermosensitive recording element of claim 1 wherein said electron accepting compound is present in the amount of 100 to 200% by weight based on the weight of said dye precursor.

10. The thermosensitive recording element of claim 1 wherein said crosslinking agent is glyoxal.

11. The thermosensitive recording element of claim 1 wherein said crosslinking agent is glutaric dialdehyde.

12. The thermosensitive recording element of claim 1 wherein said crosslinking agent is propionaldehyde diethylacetal.

13. The thermosensitive recording element of claim 1 wherein said crosslinking agent is present in the amount of 2 to 6 percent based on the total layer coating composition.

14. The thermosensitive recording element of claim 1 wherein said crosslinking agent is present in the amount of 3 to 5 percent based on the total layer coating composition.

15. The thermosensitive recording element of claim 1 wherein said second layer further comprises a catalyst.

16. The thermosensitive recording element of claim 1 wherein said organic polymeric binder in said first and second layers are selected from the group consisting of starches, hydroxyethyl cellulose, methyl cellulose, carboxymethyl cellulose, soluble collagen, gelatin, casein, polyacrylamide, polyvinyl pyrrolidone, polyvinyl alcohol, polyvinyl alcohol copolymers, sodium alginate, water soluble phenol formaldehyde resins, styrene-maleic anhydride copolymer, ethylene-maleic anhydride copolymer, ethylene vinyl acetate polymers, styrenebutadiene copolymer, acrylonitrile-butadiene copolymer and acrylic resins.

17. The thermosensitive recording element of claim 1 wherein said organic polymeric binder is applied from an aqueous solution having a concentration of 3 to 10% by weight.

18. The thermosensitive recording element of claim 1 wherein said support is a sheet material selected from the group consisting of paper, transparent films, non-woven cloth, metal foil, and composites thereof.

19. The thermosensitive recording element of claim 1 wherein at least one additional layer is present on said second layer.

20. The thermosensitive recording element of claim 19 wherein said additional layer is the outermost layer and comprises an organic polymeric binder, a crosslinking agent, a catalyst, and an electron accepting compound.

21. The thermosensitive recording element of claim 19 or 20 wherein said additional layer comprises at least one compound selected from the group consisting of pigments, waxes, higher fatty acid metal salts and optical brighteners.

22. A thermosensitive recording element having high gloss and improved abrasion resistance, said element comprising:

(a) a support;

(b) a first layer comprising an organic polymeric binder and a substantially colorless electron donating dye precursor; and (c) a second layer comprising (i) an organic polymeric binder compatible with the binder in (b), (ii) an electron accepting compound capable of forming color by reaction with said dye precursor, and (iii) a crosslinking agent selected from the group consisting of mono- and polyfunctional aldehydes, blocked dialdehydes, $\alpha$-diketones, active esters, active halogen compounds, s-triazines, diazines, epoxides, aziridines, halogen-substituted aldehyde acids, vinyl sulfones containing hardening functional groups, and polymeric crosslinking agents;

wherein the first layer is interposed between the support and the second layer and together form a coating on said support;

said organic polymeric binder in said first and second layers are water soluble binders having a molecular weight of 20,000 to 200,000.

23. The thermosensitive recording element of claim 22 wherein said second layer further comprises a catalyst.

24. The thermosensitive recording element of claim 22 wherein said coating on said support has a high gloss indicated by a reflectance of at least 60 percent.

25. The thermosensitive recording element of claim 22 wherein said coating on said support is white in color.

* * * * *

UNITED STATES PATENT AND TRADEMARK OFFICE

CERTIFICATE OF CORRECTION

PATENT NO. : 5,418,206

DATED : May 23, 1995

INVENTOR(S) : Albert H. Smith

It is certified that error appears in the above-indentified patent and that said Letters Patent is hereby corrected as shown below:

On the title page delete the following disclaimer language:

[*] Notice: "The portion of the term of this patent subsequent to October 22, 2009 has been disclaimed."

Signed and Sealed this

Twenty-ninth Day of August, 1995

*Attest:*

Bruce Lehman

BRUCE LEHMAN

*Attesting Officer*

*Commissioner of Patents and Trademarks*